US012036442B1

(12) United States Patent
Tannar

(10) Patent No.: US 12,036,442 B1
(45) Date of Patent: Jul. 16, 2024

(54) SYSTEMS AND METHODS FOR DYNAMIC PREDICTION OF FLIGHT BALLISTICS

(71) Applicant: D.O.P.E. Golf, LLC, Walpole, MA (US)

(72) Inventor: Sidney Kenneth Tannar, Nanoose Bay (CA)

(73) Assignee: D.O.P.E GOLF, LLC, Walpole, MA (US)

( * ) Notice: Subject to any disclaimer, the term of this patent is extended or adjusted under 35 U.S.C. 154(b) by 0 days.

(21) Appl. No.: 18/427,062

(22) Filed: Jan. 30, 2024

(51) Int. Cl.
*A63B 24/00* (2006.01)
*A63B 69/36* (2006.01)

(52) U.S. Cl.
CPC ..... *A63B 24/0021* (2013.01); *A63B 69/3658* (2013.01); *A63B 2024/0034* (2013.01); *A63B 2220/35* (2013.01)

(58) Field of Classification Search
CPC ..... A63B 24/0021; A63B 69/3658; A63B 2024/0034; A63B 2220/35
See application file for complete search history.

(56) References Cited

U.S. PATENT DOCUMENTS 8,512,162 B2 * 8/2013 Kim ..... G09B 19/0038 473/407
9,224,130 B2 * 12/2015 Klaus ..... G06Q 10/105
9,597,567 B1 * 3/2017 Tran ..... A63B 71/06
10,052,542 B2 * 8/2018 Tuxen ..... A63B 69/36
10,232,225 B1 * 3/2019 Oberc ..... A63B 69/3655
10,393,870 B2 * 8/2019 Tuxen ..... G01S 13/58
10,456,651 B2 * 10/2019 Choi ..... A63B 69/3658
10,605,910 B2 * 3/2020 Du Toit ..... G01S 7/003
10,751,575 B2 * 8/2020 Komatsu ..... A63B 37/00921
11,040,264 B2 * 6/2021 Jang ..... H04L 67/131
11,344,784 B1 * 5/2022 Dykhuis ..... A63B 37/0076
11,786,794 B1 * 10/2023 Raposo ..... A63B 37/0076 473/353
2011/0250939 A1 * 10/2011 Hobler ..... A63F 13/61 463/7
2013/0274040 A1 * 10/2013 Coza ..... A63B 43/004 473/570
2016/0199693 A1 * 7/2016 Vermilyea ..... A61B 5/1128 700/91
2022/0305335 A1 * 9/2022 Togasaka ..... H04M 1/72403
2023/0108761 A1 * 4/2023 Broadie ..... G06Q 50/10 473/407
2023/0310964 A1 * 10/2023 Goodchild ..... G01S 17/88 473/199
2023/0364468 A1 * 11/2023 Okur ..... G06V 20/42
2023/0398427 A1 * 12/2023 Aksamit ..... A63F 13/5255

* cited by examiner

*Primary Examiner* — Reginald A Renwick
(74) *Attorney, Agent, or Firm* — Volpe Koenig

(57) ABSTRACT

In some aspects, the disclosure is directed to methods and systems for an improved ballistics calculator allowing faster and more efficient estimation of flight characteristics. Using an array of calculation coefficients and starting from initial values for primary ballistics variables, implementations of these methods and systems may iteratively select a set of coefficients; adjust the primary ballistics variables based on a change in time; and reselect a new set of coefficients, providing highly accurate estimations in real-time while reducing processor resources required for more complex calculations or real-time visual or radar tracking systems.

20 Claims, 6 Drawing Sheets

SYSTEMS AND METHODS FOR DYNAMIC PREDICTION OF FLIGHT BALLISTICS

FIELD OF THE DISCLOSURE

This disclosure generally relates to systems and methods for ballistic computations for objects in flight. In particular, this disclosure relates to systems and methods for applying ballistic computations with atmospheric measurements and measurements of object launch characteristics to predict flight characteristics.

BACKGROUND OF THE DISCLOSURE

Flight characteristics of ballistic or unpowered objects may be difficult to accurately predict due to variations in launch characteristics, atmospheric effects, and other physical effects, and the range of variation may be huge relative to the size of the object. For example, standard golf balls are approximately 1.68 inches in diameter, but a typical driver shot may carry anywhere between 100 to 300 yards, with many shots being outside of that range. Similarly, an average drive in disc golf can be around 50 to 150 yards, with huge variation due to wind, launch angle, spin, etc. More extreme sports such as pumpkin chucking (i.e. launching a pumpkin or similar sized object for distance or accuracy using mechanical means) may have distance records approaching a mile.

While some systems for predicting flight characteristics exist, these typically rely on either continuous tracking of the object (e.g. via radar or lidar), or performing an initial estimation that quickly becomes inaccurate, particularly for longer distances. Conversely, more accurate systems that perform complex ballistics calculations may be slow and inefficient and inappropriate for real-time or "live" use.

BRIEF DESCRIPTION OF THE DRAWINGS

Various objects, aspects, features, and advantages of the disclosure will become more apparent and better understood by referring to the detailed description taken in conjunction with the accompanying drawings, in which like reference characters identify corresponding elements throughout. In the drawings, like reference numbers generally indicate identical, functionally similar, and/or structurally similar elements.

Figure 1:
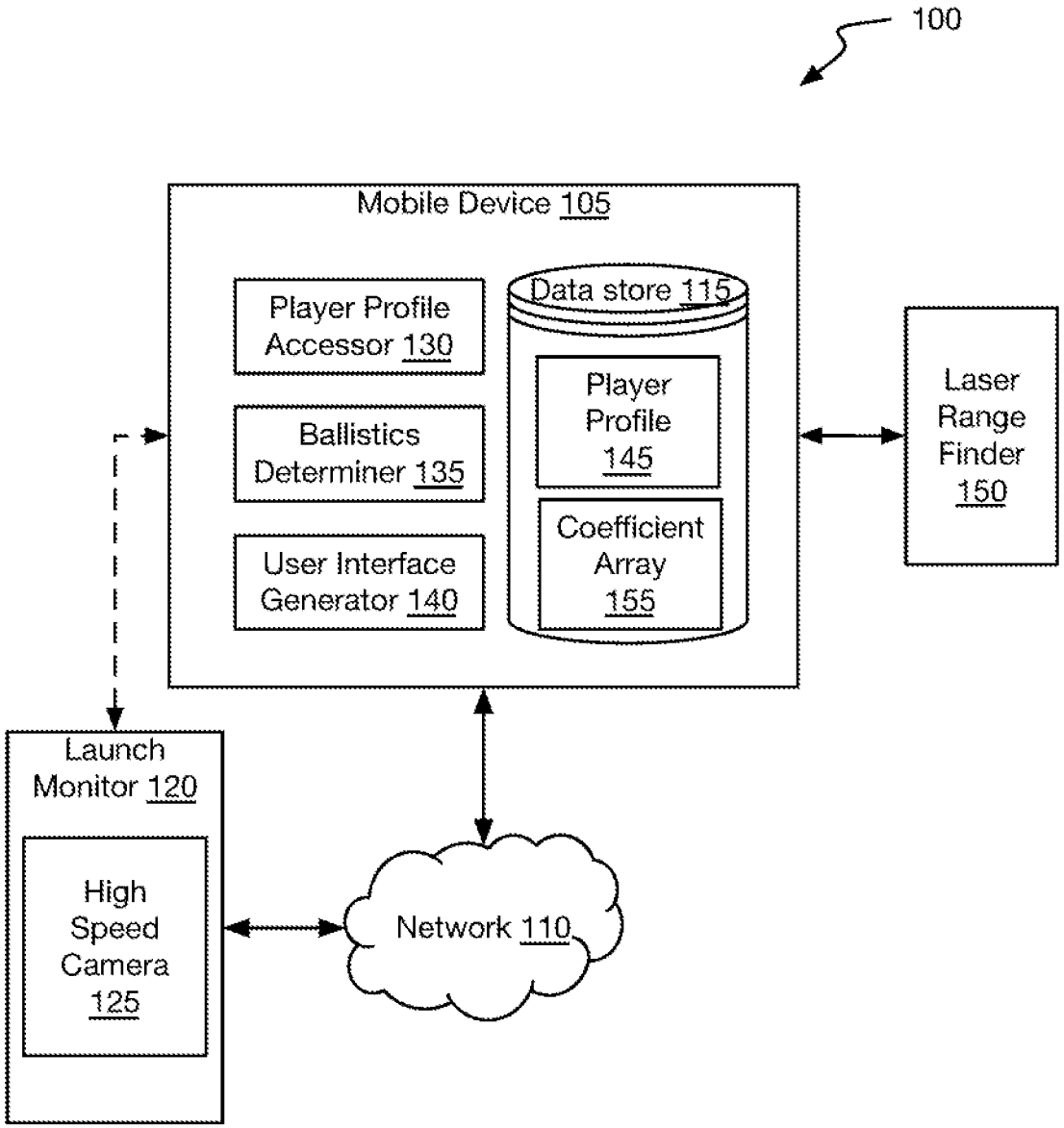
FIG. 1 is a block diagram illustrating an example system for using real-time ballistic computations to determine a predicted distance of a golf ball based on player profile information.

The details of various embodiments of the methods and systems are set forth in the accompanying drawings and the description below.

DETAILED DESCRIPTION

For purposes of reading the description of the various embodiments below, the following descriptions of the sections of the specification and their respective contents may be helpful:

Section A describes embodiments of systems and methods for dynamic prediction of flight ballistics; and Section B describes a computing environment which may be useful for practicing embodiments described herein.

A. Systems and Methods for Dynamic Prediction of Flight Ballistics

As discussed above, flight characteristics of ballistic objects may be difficult to accurately predict, due to variations in launch characteristics, atmospheric effects, and other physical effects, and the range of variation may be huge relative to the size of the object. Predicting flight characteristics using continuous tracking of the object (e.g. via radar or lidar) may be expensive and unavailable for most uses, and while they may establish a "baseline" or typical shot, such a shot may not be representative of conditions found in the field or during a subsequent launch. Systems that perform complex ballistics calculations may be slow and inefficient and inappropriate for real-time or "live" use.

Aspects of the present disclosure are directed to a ballistic computer, such as those traditionally used in the field of long range ballistic marksmanship, but with improvements allowing faster and more efficient estimation of flight characteristics compared to traditional systems. By finding the flight characteristics produced by each specific launching user or device (e.g. swing, clubs being used, type and weight of disc, launch angles, etc.) and by using a launch monitor computing device to capture data relating to at least these factors, implementations of these devices can provide accurate estimations of distance travelled and, in some implementations, lateral deflection from a straight path, given changes in temperature, humidity, barometric pressure, elevation, or other factors. Further, the systems and methods of this technical solution can provide a mobile application that can present a graphical user interface including such information.

In particular, to provide efficient and fast estimation, implementations of the systems and methods discussed herein may utilize an array of calculation coefficients, or a two (or higher) dimensional array in which each cell comprises a set of coefficient values for use in ballistics calculations, such as lift and drag coefficients. The dimensions or indices of the array may correspond to a first set of ballistic variables (referred to as primary variables in some implementations), such as velocity or spin ratio, and a value or cell in the array may be initially selected based on starting or launch values for these primary variables. The coefficient values may also include coefficients for adjustment of the primary variables. To perform the estimation, starting from the initial values of the primary variables, the system may iteratively select a set of coefficients; adjust the primary variables based on a change in time (e.g. stepping forward by a predetermined time amount, such as 5 milliseconds, 50 milliseconds, 500 milliseconds, 1 second, or any other such value); and reselecting a new set of coefficients.

While the following discussion primarily focuses on golf balls, the systems and methods discussed herein may be applied to dynamic estimations of flight characteristics of any object, such as Frisbees or flying discs, baseballs, softballs, basketballs, tennis balls, cricket balls, or other game balls, as well as other projectiles such as arrows, bolts, bullets, shot, or other such unpowered launched, hit, or thrown objects. The various drag and lift coefficients may be varied for different objects, but many implementations of the systems and methods discussed herein utilizing an iterative application of coefficients from a coefficient array may apply to these other contexts. Accordingly, the systems and methods herein should not be considered to be limited to golf ball flight estimations.

The trajectory of an object, such as a golf ball, can be governed by numerous factors and forces. For example, certain golf clubs apply force differently to a golf ball upon impact, may have different aerodynamic properties affecting swing velocity, and may produce undesired results based on atmospheric or environmental conditions. To compensate for these issues, the systems and methods of this technical solution can provide a ballistic computer specialized in the form of a mobile application for determining and tracking the trajectory of a golf ball. The mobile application can access player information, for example from a player profile, that can include player data such as golf club types, average golf club swing velocity, average golf club head speed, and average golf club swing angle, among others. The player information may be stored locally in a database, or in a remote database that maintains a player profile.

The systems and methods of this technical solution can identify and determine specific ball flight characteristics produced by each club when swung. This information can be gathered, for example, by communicating with at least one launch monitor or other data. For example, a golfer will swing a golf club with a specific speed dependent upon their strength and technique. The resulting trajectory of a golf ball will depend on the loft of the club face and degree of centeredness of the impact between the face and the ball. In some implementations, the system can predict the trajectory characteristics for a golfer's clubs. The system can be used to predict, in general, patterns for the distance effect of changes in temperature, altitude, humidity, air pressure, wind and elevation changes (hitting uphill or downhill). In some implementations, the system can be used to gather information about the player, for example to assemble, generate, or otherwise create a user profile, using a launch monitor. Using input gathered from the user via the graphical user interface, an application executing on a mobile device may update or populate the player profiles as described herein.

In some implementations, the systems and methods of this technical solution can create, set, and maintain a player profile including constants in the application, such as a local or remote database or data storage. The player constants values in the profile can include information about various golf clubs used by the user, including club type, golf club shaft type and flex, or the preferred type or brand of golf ball used. This technical solution can collect their ballistic averages for each club, and generate a personalized player profile that includes this information. This technical solution can also provide a ballistic forecasting feature, which can allow the player to forecast predicted ballistic information 12 hours ahead. For example, if there is a weather front coming in, or a drastic change in atmospheric or environmental conditions during a future time, this technical solution can access and retrieve forecasted weather data and compute golf ball ballistic information given the predicted changes in atmospheric or environmental conditions. The player can use this information, for example, to compensate for undesirable future weather conditions. This is particularly useful when the real-time use of the systems and methods described herein may be prohibited by organizational rules or rules of competitive play.

The systems and methods of this technical solution can utilize a launch monitor (e.g. or a high-speed camera, etc.) to establish a baseline profile. Then, this technical solution can utilize the output features of the launch monitor to identify the distance a ball will travel using the baseline player profile and currently monitored temperature and atmospheric or environmental data. Accordingly, this technical solution allows for accurate computations of real-time golf ball ballistic data without the use of extra equipment (e.g., an expensive launch monitor, etc.) which is an improvement to golf ball tracking systems.

The mobile device can be executed, for example, on a smartphone, which can download accurate and up-to-date atmospheric or environmental data from given a location in real time. The application can be used to be used prior to and during a round of golf and does not need any specialized equipment to operate.

This technical solution can implement computer hardware or software that provides ballistic computations that are tailored to golf. Testing the accuracy of this technical solution, or otherwise calibrate aspects of this technical solution, can be performed in conjunction with a launch monitor. Using publicly available or privately maintained atmospheric or environmental data based on a provided GPS location, the application can determine and provide real-time ballistic computations of predicted golf ball distance. The ballistic computations can be based on, for example, flight data of various golfers, clubs, and golf balls that may be gathered via launch monitor device. The golfer's ball flight data can include golf ball spin rate, maximum ordinate, golf ball carry distance, golf ball speed, and player swing speed. The golf ball flight data can be stored, for example, in one or more data structures in a data storage memory as part of a user profile. In some implementations, the data used to establish a ballistic profile can be entered manually by the player (e.g., via the graphical user interface provided by the application, etc.). In another implementation, the ballistic data can be gathered directly from a launch monitor.

At least one other aspect of this technical solution includes a laser range tinder with Bluetooth capability to upload the golfer's data, lase (determine distance to) the flag (e.g., the flag marking the position of the target hole), and tell the player which club to use based on the changes in atmospheric or environmental conditions. The range finder can read the winds (e.g., gather speed and direction data, etc.) between the golfer and the target, and give the golfer a red target line to account for hold off due to wind.

Accordingly, the systems and methods of this technical solution can identify accurate distances that a player may hit in certain atmospheric or environmental conditions for each club that the player uses. This technical solution can compensate for future or current changes in atmospheric or environmental conditions, and can provide updated ballistic computation data in real-time. Further, after establishing a baseline profile for a player, this technical solution can operate without the use of external equipment such as a launch monitor. Instead, this technical solution can be provided on a mobile device of player, such as a smartphone, and produce a ballistic solution for a predicted location (e.g., distance from the player) that the golf ball with land given a particular club.

FIG. 1 is a block diagram illustrating an example system 100 for using real-time ballistic computations to determine a predicted distance of a launched object, such as a golf ball, based on launch characteristics, such as player profile information. The system 100 can include at least one mobile device 105, at least one network 110, at least one launch monitor 120, and at least one laser range finder 150. The mobile device 105 can include at least one player profile accessor 130, at least one ballistics determiner 135, at least one user interface generator 140, and at least one database 115. The database 115 can maintain, store, or otherwise include at least one player profile. The launch monitor can include at least one high speed camera 125.

Figure 4A:
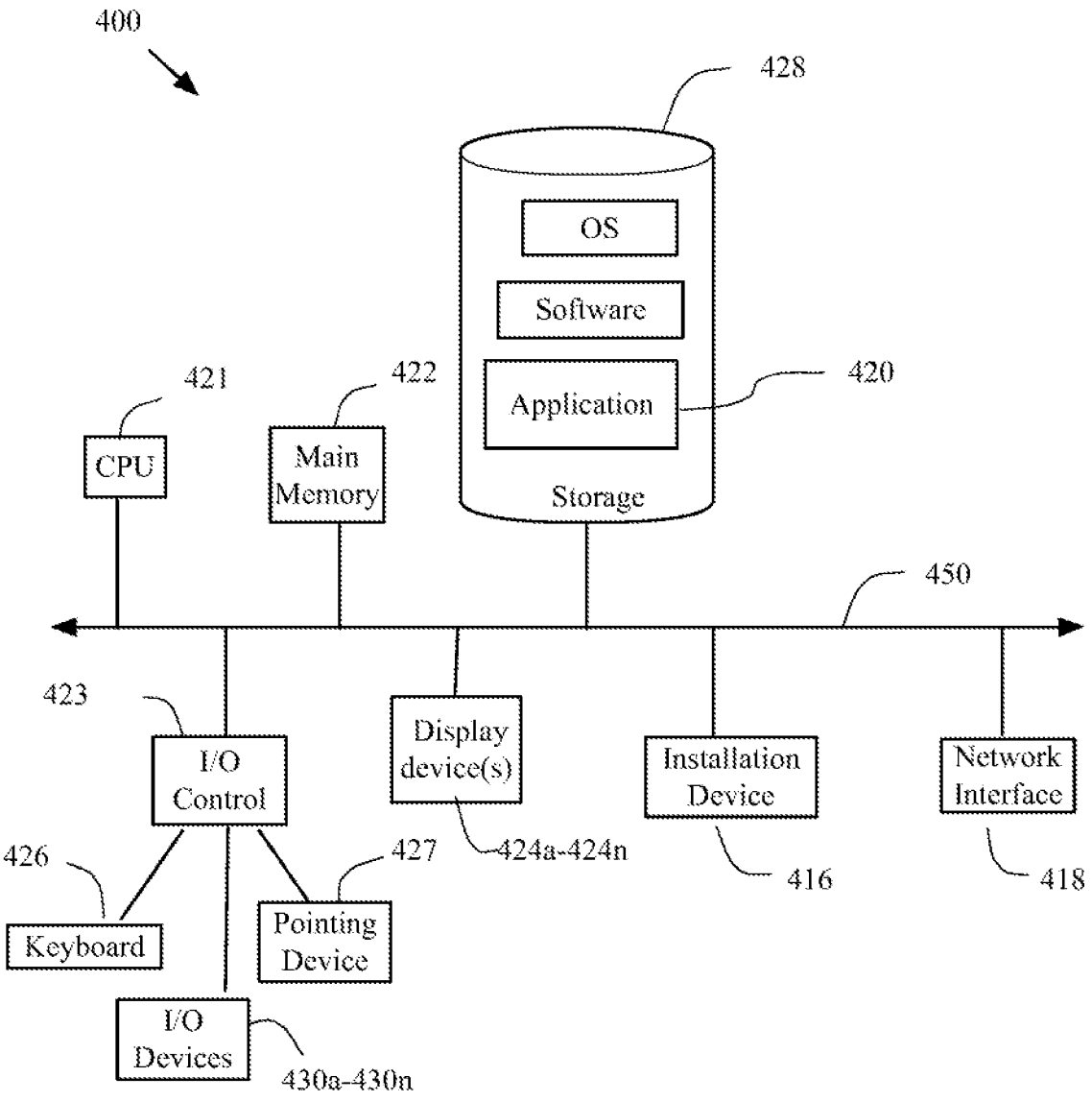
FIGS. 4A and 4B are block diagrams depicting embodiments of computing devices useful in connection with the methods and systems described herein.
Figure 4B:
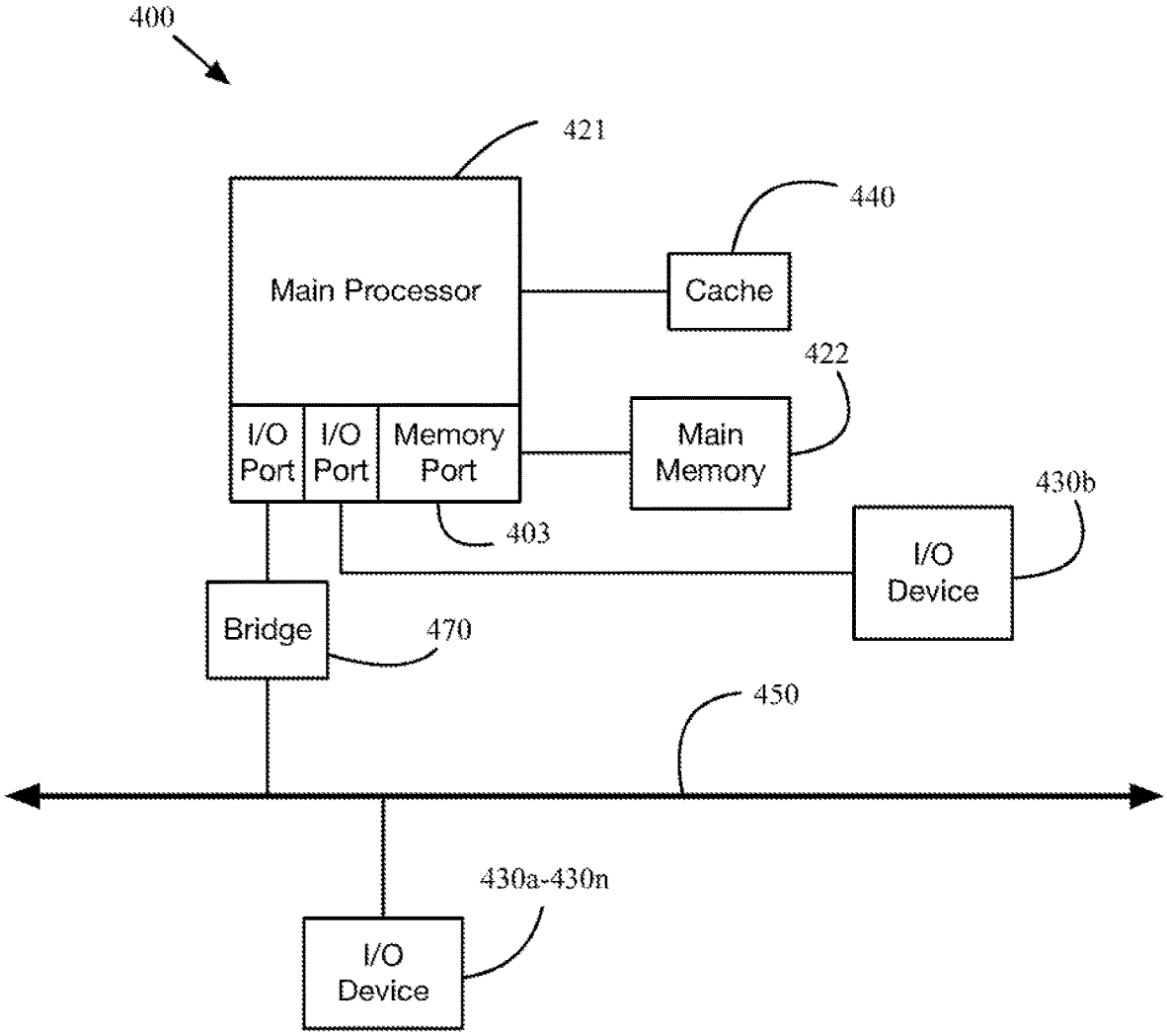

Each of the player profile accessor 130, ballistics determiner 135, user interface generator 140, database 115, mobile device 105, launch monitor 120, and laser range finder 150 of the system 100 can be implemented using the hardware components or a combination of software with the hardware components of a computing system (e.g., computing system 100 or any other computing system described herein, etc.) detailed herein in conjunction with FIGS. 4A-4B. Each of the components of the mobile device 105 can perform any of the functionalities detailed herein.

The mobile device 105 can include at least one processor and a memory, e.g., a processing circuit. The memory can store processor-executable instructions that, when executed by processor, cause the processor to perform one or more of the operations described herein.

The processor may include a microprocessor, an application-specific integrated circuit (ASIC), a field-programmable gate array (FPGA), etc., or combinations thereof. The memory may include, but is not limited to, electronic, optical, magnetic, or any other storage or transmission device capable of providing the processor with program instructions. The memory may further include a floppy disk, CD-ROM, DVD, magnetic disk, memory chip, ASIC, FPGA, read-only memory (ROM), random-access memory (RAM), electrically erasable programmable ROM (EEPROM), erasable programmable ROM (EPROM), flash memory, optical media, or any other suitable memory from which the processor can read instructions. The instructions may include code from any suitable computer programming language. The mobile device 105 can include one or more computing devices or servers that can perform various functions as described herein. The mobile device 105 can include any or all of the components and perform any or all of the functions of the computer system 100 described herein in conjunction with FIGS. 4A-4B.

The network 110 can include computer networks such as the Internet, local, wide, metro or other area networks, intranets, satellite networks, other computer networks such as voice or data mobile phone communication networks, and combinations thereof. The mobile device 105 of the system 100 as described herein can communicate via the network 110, for instance with at least one launch monitor 120 or at least one laser range finder 150. The network 110 may be any form of computer network that can relay information between the mobile device 105, other computing devices, and one or more content sources, such as web servers, weather forecasting servers, or servers that maintain atmospheric or environmental conditions, amongst others. In some implementations, the network 110 may include the Internet and/or other types of data networks, such as a local area network (LAN), a wide area network (WAN), a cellular network, a satellite network, or other types of data networks. The network 110 may also include any number of computing devices (e.g., computers, servers, routers, network switches, etc.) that are configured to receive and/or transmit data within the network 110. The network 110 may further include any number of hardwired and/or wireless connections. Any or all of the computing devices described herein (e.g., the mobile device 105, the computer system 100, the launch monitor 120, other computing devices described herein, etc.) may communicate wirelessly (e.g., via WiFi, cellular, radio, etc.) with a transceiver that is hardwired (e.g., via a fiber optic cable, a CAT5 cable, etc.) to other computing devices in the network 110. Any or all of the computing devices described herein (e.g., the mobile device 105, the computer system 100, the launch monitor 120, other computing devices described herein, etc.) may also communicate wirelessly with the computing devices of the network 110 via a proxy device (e.g., a router, network switch, or gateway).

The laser range finder 150 can include at least one processor and a memory, e.g., a processing circuit. The memory can store processor-executable instructions that, when executed by processor, cause the processor to perform one or more of the operations described herein. The processor may include a microprocessor, an application-specific integrated circuit (ASIC), a field-programmable gate array (FPGA), etc., or combinations thereof. The memory may include, but is not limited to, electronic, optical, magnetic, or any other storage or transmission device capable of providing the processor with program instructions. The memory may further include a floppy disk, CD-ROM, DVD, magnetic disk, memory chip, ASIC, FPGA, read-only memory (ROM), random-access memory (RAM), electrically erasable programmable ROM (EEPROM), erasable programmable ROM (EPROM), flash memory, optical media, or any other suitable memory from which the processor can read instructions. The instructions may include code from any suitable computer programming language. The laser range finder 150 can include one or more computing devices or servers that can perform various functions as described herein. The laser range finder 150 can include any or all of the components and perform any or all of the functions of the computer system 100 described herein in conjunction with FIGS. 4A-4B. The laser range finder can communicate wirelessly via Bluetooth with the mobile device 105. In some implementations, the laser range finder 150 may communicate with the mobile device 105 as described herein via one or more messages transmitted or received via the network 110.

The laser range finder 150 can communicate with at least one mobile device 105 and provide distance data and wind data for use in ballistic computations. For example, the laser range finder 150 can upload the golfer's data, lase (determine distance to) the flag (e.g., the flag marking the position of the target hole), and tell the player which club to use based on the changes in atmospheric or environmental conditions. The range finder can read the winds (e.g., gather speed and direction data, etc.) between the golfer and the target, and give the golfer a red target line to account for hold off due to wind.

The launch monitor 120 can include at least one processor and a memory, e.g., a processing circuit. The memory can store processor-executable instructions that, when executed by processor, cause the processor to perform one or more of the operations described herein. The processor may include a microprocessor, an application-specific integrated circuit (ASIC), a field-programmable gate array (FPGA), etc., or combinations thereof. The memory may include, but is not limited to, electronic, optical, magnetic, or any other storage or transmission device capable of providing the processor with program instructions. The memory may further include a floppy disk, CD-ROM, DVD, magnetic disk, memory chip, ASIC, FPGA, read-only memory (ROM), random-access memory (RAM), electrically erasable programmable ROM (EEPROM), erasable programmable ROM (EPROM), flash memory, optical media, or any other suitable memory from which the processor can read instructions. The instructions may include code from any suitable computer programming language. The launch monitor 120 can include one or more computing devices or servers that can perform various functions as described herein. The launch monitor 120 can include any or all of the components and perform any or all of the functions of the computer system 100 described herein in conjunction with FIGS. 4A-4B. The laser range finder can communicate wirelessly via Bluetooth with the mobile device 105 (e.g., as depicted by the dotted line in FIG. 1). In some implementations, the launch monitor 120 may communicate with the mobile device 105 as described herein via one or more messages transmitted or received via the network 110.

The launch monitor 120 can gather various information about a player's golf swing and provide it to the mobile device 105 for the creation of a baseline player profile. For example, the launch monitor 120 can provide the mobile device with information about flight data of the player, clubs used by the player, and golf balls used by the player. The flight data can include golf ball spin rate, max ordinate, golf ball carry distance, golf ball speed, and player swing speed. The information gathered by the launch monitor 120 can be provided to the mobile device 105, which can store the information, for example, in one or more data structures in a data storage memory as part of a user profile, such as the player profile 145.

The launch monitor 120 can include at least one high-speed camera 125, and can utilize Doppler radar to monitor the launch, full ball flight, club delivery and ball roll of a golf ball hit by the player. The launch monitor 120 can be set up behind the golfer. With each swing, the launch monitor 120 can measure every aspect of the club movement, the trajectory of the ball, and its landing. The launch monitor 120 can be equipped with a high-speed camera 125 to provide slow motion video data for analysis by the player or one or more of the computing devices described herein. Rather than calculating the projectile motion of the golf ball from initial launch parameters, the launch monitor 120 can track the entire flight of the ball from the moment of impact to the point where the ball comes to rest. The high-speed camera 125 can be any type of video camera, such as a video camera capable of capture more than 120 frames-per-second of video. This video can be transmitted, streamed, or otherwise provided to the mobile device 105.

The data store 115, sometimes referred to as a database, data storage, or by similar terms, can be a database or other computer storage structure configured to store and/or maintain any of the information described herein. The data store 115 can maintain one or more data structures, which may contain, index, or otherwise store each of the values, pluralities, sets, variables, vectors, or thresholds described herein. The data store 115 can be accessed using one or more memory addresses, index values, or identifiers of any item, structure, or region maintained in the data store 115. The data store 115 can be accessed by the components of the mobile device 105, or any other computing device described herein, via the network 110. In some implementations, the data store 115 can be internal to the mobile device 105. In some implementations, the data store 115 can exist external to the mobile device 105, and may be accessed via the network 110. The data store 115 can be distributed across many different computer systems or storage elements, and may be accessed via the network 110 or a suitable computer bus interface. The mobile device 105 can store, in one or more regions of the memory of the mobile device 105, or in the data store 115, the results of any or all computations, determinations, selections, identifications, generations, constructions, or calculations in one or more data structures indexed or identified with appropriate values. Any or all values stored in the data store 115 may be accessed by any computing device described herein, such as the mobile device 105, to perform any of the functionalities or functions described herein.

The player profile 145 may be generated, created, maintained, and updated by the mobile device 105. The player profile 145 can include an identifier of the player, an identifier of the mobile device, and identifiers and data relating to one or more clubs of the player or baseline atmospheric or environmental conditions under which the data in the player profile 145 was gathered. The player profile 145 can store or maintain any of the data gathered by the launch monitor 120, such as flight data of the player, clubs used by the player, and golf balls used by the player. The flight data can include golf ball spin rate, max ordinate, golf ball carry distance, golf ball speed, and player swing speed. All of this information can be averaged information, or information that is gathered into many data points that are then averaged (or weighted averaged, etc.) to arrive at average player flight information under certain baseline atmospheric or environmental conditions.

The player profile accessor 130 may comprise an application, service, server, daemon, or other executable logic for writing, reading, storing, maintaining, and updating one or more player profiles 145. The player profile accessor 130 may be embodied in software, hardware, or a combination of hardware and software. For example, in some implementations, player profile accessor 130 may comprise an ASIC or FPGA encoded with logic for maintaining a player profile.

The player profile accessor 130 can receive player data from the launch monitor 120 to generate or update the player profile 145. For example, the player profile accessor 130 can receive maintain any of the data gathered by the launch monitor 120, such as flight data of the player, clubs used by the player, and golf balls used by the player. The flight data can include golf ball spin rate, max ordinate, golf ball carry distance, golf ball speed, and player swing speed. All of this information can be averaged information, or information that is gathered into many data points that are then averaged (or weighted averaged, etc.) to arrive at average player flight information under certain baseline atmospheric or environmental conditions. The player profile accessor 130 can store this information as the player profile. To store the baseline atmospheric or environmental conditions, the player profile accessor 130 can receive atmospheric or environmental conditions, for example, temperature, humidity, barometric pressure, GPS coordinates of the mobile device 105, and elevation, from one or more data sources via the network 110 or from one or more components of the mobile device 105.

The player profile accessor 130 can determine if enough data has been received to create a baseline player profile. For example, the player profile accessor 130 may use a predetermined number of data points (e.g., 5, 10, 20, 25, etc.) prior to averaging the flight data for each club of the player. The player profile accessor 130 can utilize a counter to count the number of data points (e.g., swings, etc.) captured by the launch monitor 120. If the counter is equal to or greater than a threshold number of swings, the player profile accessor 130 can determine that enough data has been gathered to generate a user profile. If the counter is less than or equal to the threshold, the player profile accessor 130 can continue to gather swing data from the launch monitor 120.

The player profile accessor 130 can average the swing data and the flight data received from the launch monitor 120 to generate a user profile. For example, for each swing recorded by the launch monitor 120, the player profile accessor 130 can receive and store that information in one or more data structures in the memory of the mobile device 105. To generate a baseline player profile, the player profile accessor 130 can average each aspect (e.g., golf ball spin rate, max ordinate, golf ball carry distance, golf ball speed, and player swing speed, etc.) of the swings for a particular club used by the user to arrive at an average player profile. The player profile accessor 130 can repeat this process for each club specified by the user.

The player profile accessor 130 can store the average player profile as the player profile 145 in the database 115. In some implementations, the player profile accessor 130 can access atmospheric or environmental conditions, such as those gathered from another computing device via the network 110, or from the launch monitor 120, and store the average player profile in association with the atmospheric or environmental conditions. As such, the baseline player swing and flight data is stored with information about the atmospheric or environmental conditions under which the swing and flight data was gathered, thereby creating a baseline profile for the player.

Ballistics determiner 135 may comprise an application, service, server, daemon, or other executable logic for identifying atmospheric or environmental conditions, launch conditions, and/or for estimating flight characteristics of an object, such as a golf ball. Ballistics determiner 135 may be embodied in software, hardware, or a combination of hardware and software. For example, in some implementations, ballistics determiner 135 may comprise an ASIC or FPGA encoded with logic for executing an iterative estimation algorithm.

The ballistics determiner 135 can identify one or more atmospheric or environmental conditions. After establishing the profile, the mobile device 105, for example as part of an application, may provide the functionalities detailed herein above or the functionalities detailed herein below, for example allowing the player to specify golf clubs, manually specify atmospheric or environmental conditions, or automatically gather and display atmospheric or environmental conditions from one or more sensors on the mobile device 105 (e.g., thermometer, barometer, etc.), or from one or more other computing devices via the network 110. The other computing devices can maintain, for example, the atmospheric or environmental data, and provide it to the ballistics determiner 135 in response to a request from the ballistics determiner 135.

The ballistics determiner 135 can determine ballistics for the golf ball based on the atmospheric or environmental conditions and the average flight data in the player profile 145. For example, the flight pattern of the golf ball can be affected directly by the presence of air resistance and the rotation of the ball. Looking at both air resistance and rotation flight paths can be predicted. The air resistance and rotation are used to set up a system of differential equations that can be used to predict several different flight paths or distances. The temperature, elevation, barometric pressure, and wind speed can all effect the air resistance experienced by the golf ball. Example equations used to determine flight equations for a golf ball are included below:

$$\Sigma F_y = my'' - \text{Weight} - \text{AirResistance} + \text{MagnusForce}$$

$$\Sigma F_x = mx'' - \text{AirResistance} + \text{MagnusForce}$$

$$\Sigma F_z = mz'' - \text{AirResistance} + \text{MagnusForce}$$

Where Fy is the force in the vertical direction (y-axis) experienced by the golf ball, and Fx and Fz describe motion on the plane parallel to the ground (x-axis and z-axis). The Weight is the average weight of a golf ball, AirResistance is the air resistance force experienced by the golf ball (e.g., based on atmospheric or environmental conditions, etc.), and MagnusForce is the lift force experienced based on the average spin of the golf ball (e.g., caused by the dimples on the surface, etc.).

The air resistance can be calculated, for example, using the following equation:

$$R = \left(\frac{1}{2}\right) C_D \rho A V^2$$

Where R is the force of air resistance, Cd is the drag coefficient, p is the air density (e.g., calculated based on temperature, humidity, etc.), A is the surface area of the golf ball, and V is the average velocity of the golf ball.

The Magnus force can be calculated using the following equation:

$$F_M = S(\omega \times V)$$

Where Fm is the Magnus force, S is the Magnus coefficient, ω is the average angular velocity of the golf ball (e.g., calculated based off spin data, etc.), V is the average velocity of the golf ball, and × indicates a cross-produce operation. Using the force data, the mobile device can utilize Newton's laws of motion (e.g., F=ma, etc.) to calculate the exact distance the golf ball is likely to travel in the given atmospheric or environmental conditions. The ballistics determiner 135 can use the average values for the average initial speed and spin of the ball given a certain club in the above equations to accurately estimate the expected distance traveled by the golf ball under different atmospheric or environmental conditions. The ballistics determiner 135 can store the expected distance for a particular golf club and for a particular set of atmospheric or environmental conditions in one or more data structures in the memory of the mobile device 105 for use in computations by other components of the system 100.

In many implementations, the ballistics determiner 135 may perform an iterative estimation using an array of coefficients 155. Specifically, in some implementations, the ballistics determiner 135 may calculate the amount of force on a moving golf ball in 3 dimensions, x, y and z, with x being the forward direction, y being the upward direction and z being the sideways direction. The amount of force in each direction is dependent upon the speed of the ball, the density of air, the dimensions of the ball, the number and shape of the dimples on surface of the ball, the direction of motion as well as the spin and direction of spin of the ball. For other objects, similar variables may apply.

Figure 2A:
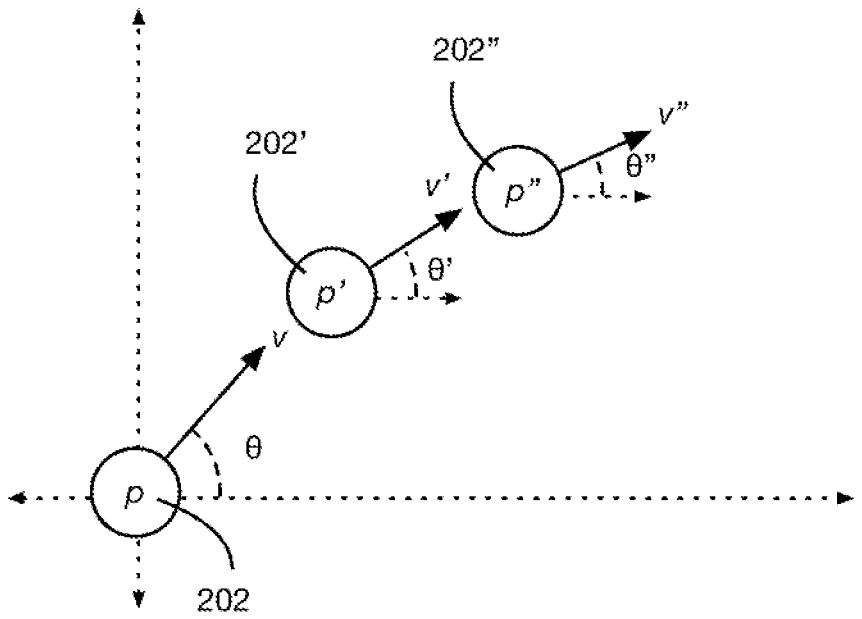
FIG. 2A is an illustration of an example of iterative dynamic ballistics calculations for predictive systems.

From the forces and their directions, Newton's 2nd Law is used to calculate the acceleration of the ball in all 3 directions from which the position and velocity of the ball is calculated at millisecond, 5 millisecond, 10 millisecond, 50 millisecond, 500 millisecond, or any other such time intervals or increments. For example, referring briefly to FIG. 2A, illustrated is an example of iterative dynamic ballistics calculations for predictive systems. An object 202, such as a golf ball, may start at a first position p (e.g. initial position, launch position, etc.) and at launch may have a corresponding initial ball speed or velocity ν at a launch angle θ, as well as other variables (not illustrated) including spin, spin axis, temperature, altitude, air pressure, wind speed and direction. At a subsequent time interval or increment (e.g. 5 milliseconds), the object 202' may have a subsequent position p', with corresponding velocity v' at angle θ'. Similarly, at a further subsequent time interval or increment (e.g. 5 milliseconds, or 10 milliseconds from launch), the object 202" may have a further subsequent position p", with a corresponding velocity v" and angle θ". Each of these new positions, velocities, angles, and other variables may be iteratively calculated for each increment, with the calculation dependent on the values calculated at a prior iteration.

Returning to FIG. 1, the ballistics determiner 135 calculates outputs of maximum height; flight time; carry distance in the x direction, y direction, and z direction; impact angle: and total distance. Ballistics determiner 135 can also use the iterative algorithm to plot the full trajectory of the golf ball. Rather than calculating each set of parameters anew at each iteration, however, the ballistics determiner may utilize a coefficient array 155, using indices of values determined during a previous iteration to retrieve coefficients for calculation of a next iteration.

Figure 2B:
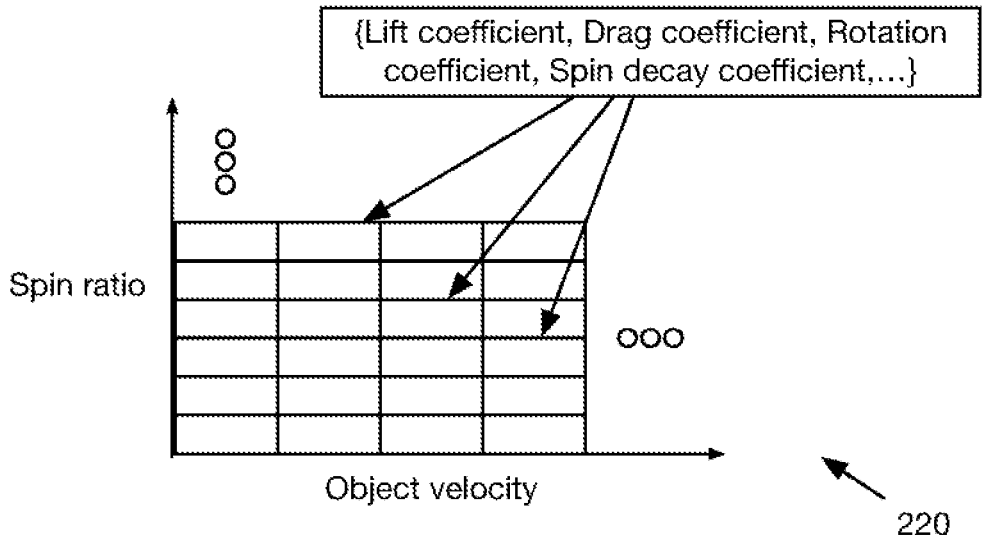
FIG. 2B is an illustration of an implementation of a coefficient array for iterative dynamic ballistics calculations for predictive systems.

For example, referring to FIG. 2B, illustrated is an implementation of a coefficient array 220 for iterative dynamic ballistics calculations for predictive systems. The array may have axes corresponding to primary variables, such as object speed or velocity (which may be an absolute velocity or total velocity in some implementations, or may be a velocity in an x, y, or z direction in some implementations) and spin ratio to object speed (e.g. golf ball spin ratio to ball speed, with the spin orthogonal to the respective x, y, z direction in some implementations, aligned with the respective x, y, z, direction in other implementations, or a total spin in some implementations). In other implementations, other primary variables may be utilized.

Each cell of the coefficient array 220 may comprise a set of coefficients, including lift coefficients, drag coefficients, rotation coefficients, spin decay coefficients, temperature adjustment coefficients, atmospheric density change coefficients, or any other type and form of coefficients for use in ballistics calculations. The set of coefficients may be stored in any suitable format, such as a concatenated string with predetermined lengths for each coefficient, delimiter-separated values, parameter-value pairs, or any other format. Although shown as an array with cells, coefficient array 220 may be in any suitable format, such as a flat file, array of arrays, etc. Although shown with two primary variables (and two dimensions), in some implementations, the array may have a higher dimensionality (for example, with axes corresponding to spin ratio, object velocity, and altitude).

Figure 2C:
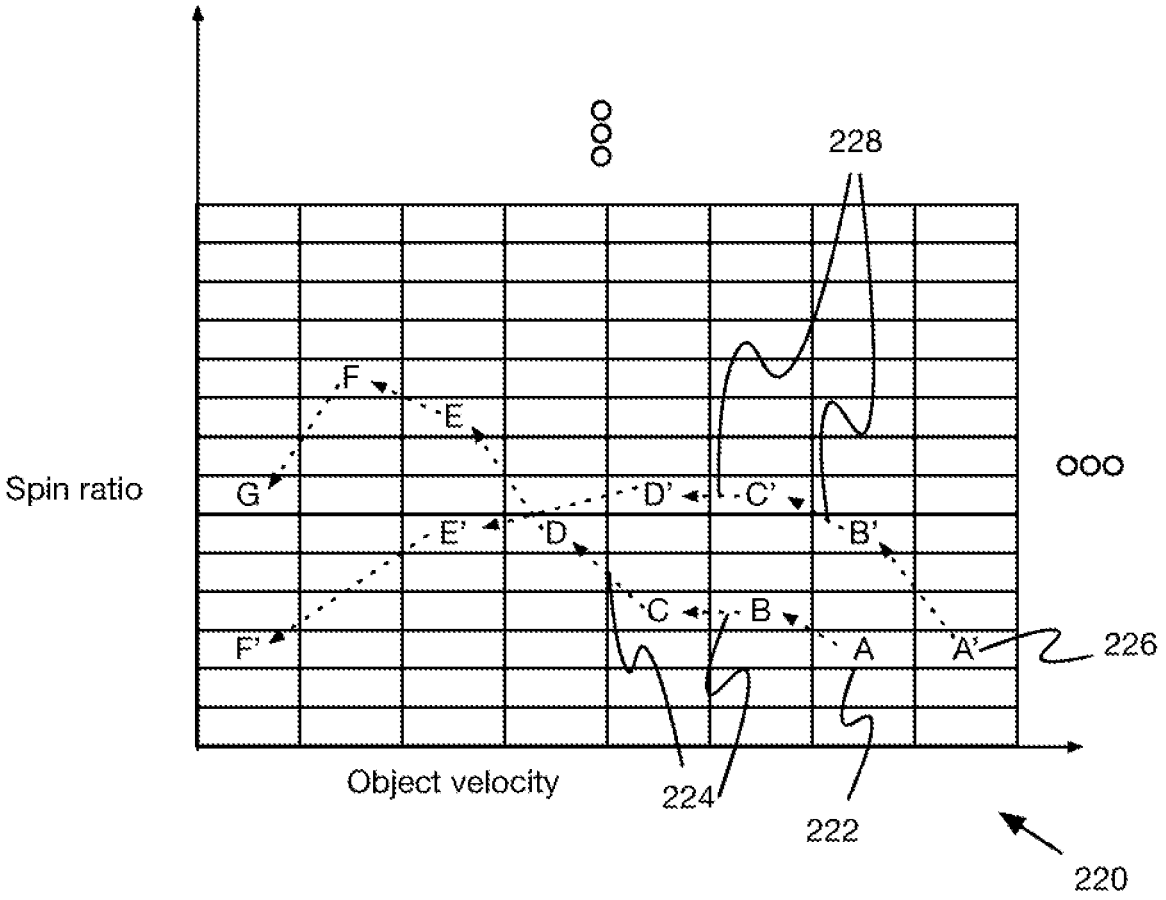
FIG. 2C is an illustration of an example of progression through a coefficient array during iterative dynamic ballistics calculations for predictive systems, according to some implementations.

During each iteration, the ballistics determiner may utilize the coefficients from the cell corresponding to the primary variable values to calculate new values for the primary variables, as well as determining a new position of the object. For example, given a first value a for spin ratio and b for object velocity, the ballistics determiner may use coefficients from the corresponding cell in the array to calculate a new spin ratio a' and/or new object velocity b'. This may proceed through each iteration, with different values determined. For example, referring now to FIG. 2C, illustrated is an example of progression through a coefficient array 220 during iterative dynamic ballistics calculations for predictive systems, according to some implementations. Given a first value for spin ratio and object velocity, the ballistics determiner may identify cell A 222 as including corresponding coefficients. The ballistics determiner may calculate a subsequent position (e.g. position at a subsequent time increment) as well as new values for the spin ratio and object velocity. At the next iteration, the ballistics determine may identify cell B as including corresponding coefficients; then cell C at the next iteration, cell D at the further next iteration, etc. This may result in a "virtual path" 224 through the array at each iteration. The path may be different, depending on the starting values of the variables. For example, given new starting values corresponding to cell A' 226, the iterations may proceed along virtual path 228 to cell B', C', etc. In many implementations, paths from different starting points may be wildly different, or may converge.

Advantageously, because coefficient values of the coefficient array are predetermined or pre-calculated, they need not be recalculated at each iteration, greatly reducing the complexity of the calculations and allowing for faster execution of the iterative algorithm. Similarly, because the coefficient values may change at each iteration, the resulting position calculations may be much more accurate than systems that use a single drag coefficient, for example, whether predetermined or determined at launch of the object.

In some implementations, the coefficient array may be prepopulated based on measurements from object launches under controlled conditions. In other implementations, the coefficient array may be prepopulated based on repeated calculations with varying simulated variables. As discussed above, the coefficient array may have higher dimensionality to account for other variables, such as altitude or atmospheric pressure. Accordingly, in some such implementations, the virtual path through the array may not be two-dimensional. For example, given a third primary variable of atmospheric pressure and a three-dimensional array, if calculations during an iteration indicate that due to altitude gained during flight, pressure will be reduced, a new cell may be selected corresponding to the changes in spin ratio, velocity, and pressure. In other implementations, different coefficient arrays may be stored in a data store, and a coefficient array from a plurality of coefficient arrays may be selected for use based on such other variables. This may be useful, for example, in instances in which a variable may affect the coefficients of the array, but may not necessarily change during flight of the object, such as ground temperature (e.g. thus requiring only a two-dimensional army), the system may select the corresponding two-dimensional array for use at launch.

Returning to FIG. 1, the user interface generator 140 can generate a user interface to display or gather any of the information described herein. For example, the user may populate one or more data structures, profile information, average ballistics or flight information, or any other information used by the mobile device 105 or the components thereof. In addition, the user interface generator 140 can display or provide the results of any of the computations, for example in one or more windows, applications, or graphical representations on the mobile device 105. The user interface generator 140 can display, for example as text or an image, the current atmospheric or environmental data, projected atmospheric or environmental data, future atmospheric or environmental data, or the expected distance a golf ball will travel for a particular club and player profile 145. If, for example, data gathered from the laser range finder 150 indicates that the target hole is a certain distance away, the user interface generator 140 can display a club that will provide an average expected distance for a golf ball given the current or future atmospheric or environmental conditions.

Figure 3:
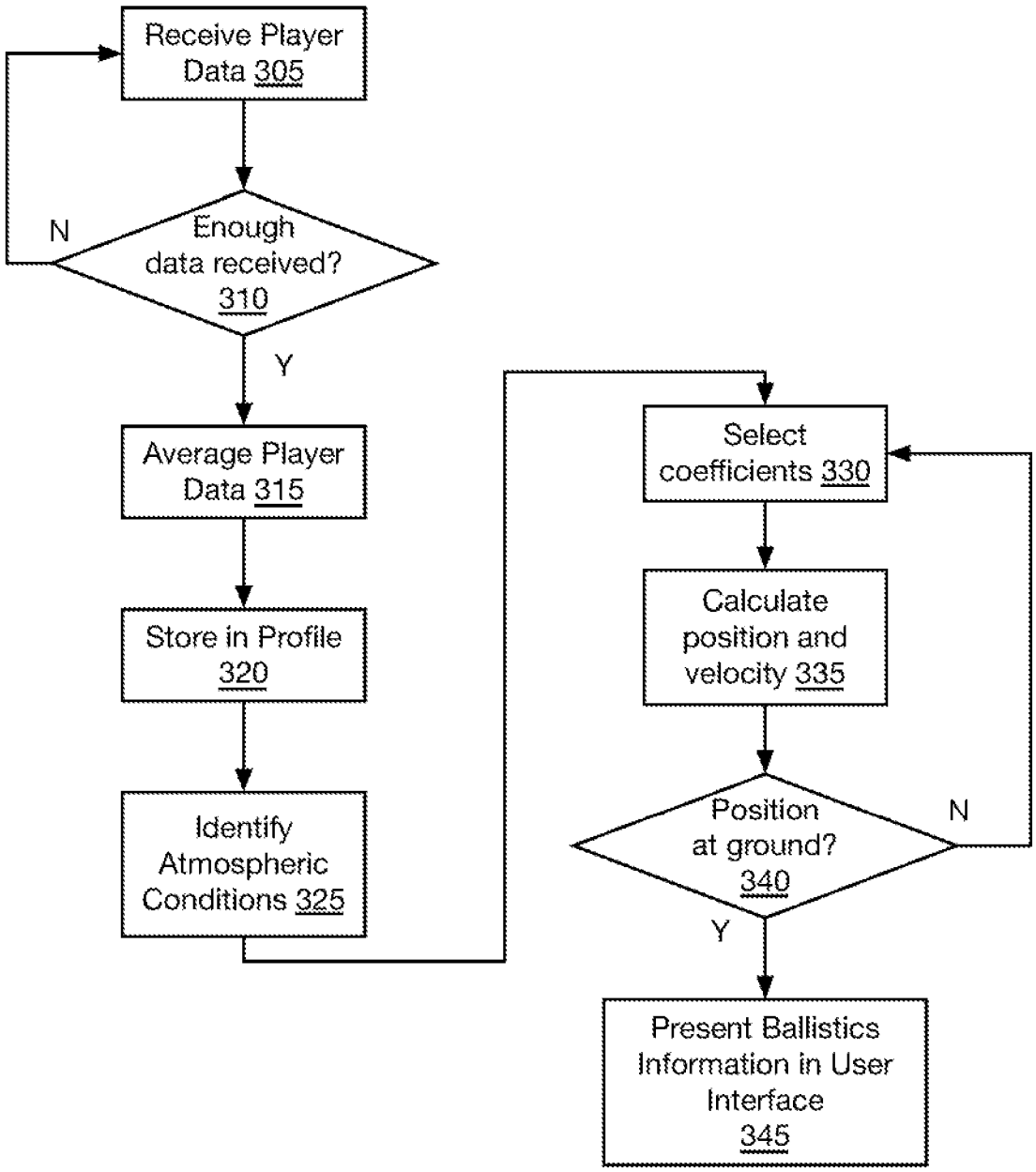
FIG. 3 is a flow chart of an implementation of a method for dynamic prediction of ballistics.

FIG. 3 is a flow chart of an implementation of a method for dynamic prediction of ballistics. Although primarily discussed in terms of golf play, as discussed above, this method may apply to prediction of flight characteristics for any hit, thrown, or launched object. In brief overview, at step 305, the system may receive player data. At step 310, the system may determine whether enough data has been received, and if not, repeat steps 305-310. At step 315, once enough data has been received, the player data may be averaged to generate a baseline profile. At step 320, the profile may be stored in the database. At step 325, the system may identify atmospheric or environmental conditions. At step 330, the system may select initial coefficients from the coefficient army, based on the identified atmospheric or environmental conditions and/or baseline profile parameters. At step 335, the system may calculate a new position and velocity for the object based on the selected initial coefficients, atmospheric or environmental conditions, and player parameters. At step 340, the system may determine whether to continue iterating, by, for example, whether the object position is on the ground. If not, steps 330-340 may be repeated. If so, then at step 345, the ballistics information, including the final estimated position and positions during flight, may be displayed in the user interface.

Still referring to FIG. 3 and in more detail, at step 305, the system may receive player data. The system (e.g. mobile device or other computing device), may receive player data from the launch monitor (e.g., the launch monitor 120), an external launch monitor, or manually entered data (e.g. from prior uses of a launch monitor) to generate or update the player profile (e.g., the player profile 145). For example, the system can receive or maintain any of the data gathered by the launch monitor, such as flight data of the player, clubs used by the player, and golf balls used by the player. The flight data can include a golf ball spin rate and axis, max ordinate or highest altitude above ground of a particular drive or hit, a golf ball carry distance, a golf ball speed, a vertical launch angle, a horizontal launch deflection, and player swing speed. All of this information can be averaged information, or information that is gathered into many data points that are then averaged (or weighted averaged, etc.) to arrive at average player flight information under certain baseline atmospheric or environmental conditions. The system can store this information as the player profile. To store the baseline atmospheric or environmental conditions, the system can receive atmospheric or environmental conditions, for example, temperature, humidity, barometric pressure, GPS coordinates of the mobile device, and elevation, from one or more data sources via a network (e.g., the network 110) or from one or more components of the system (e.g. GPS receiver, barometric sensor, network accessible weather service, etc.).

In some implementations at step 310, the system can determine whether enough data has been received to create a baseline player profile. For example, the system may use a predetermined number of data points (e.g., 5, 10, 20, 25, etc.) prior to averaging the flight data for each club of the player. The system can utilize a counter to count the number of data points (e.g., swings, etc.) captured by the launch monitor (e.g., incrementing each time, etc.). If the counter is equal to or greater than a threshold number of swings, the system can determine that enough data has been gathered to generate a user profile and perform step 315 of the method 300. If the counter is less than or equal to the threshold, the system can continue to gather swing data from the launch monitor or other data sources (e.g., manual input, etc.).

At step 315 in some embodiments, the system can average the player data. The system can average the swing data and the flight data received from the launch monitor or other data sources to generate a player profile (e.g., the player profile 145). For example, for each swing recorded by the launch monitor, the system can receive and store that information in one or more data structures in the memory of the system. To generate a baseline player profile, the system can average each aspect (e.g., golf ball spin rate, max ordinate, golf ball carry distance, golf ball speed, and player swing speed, etc.) of the swings for a particular club used by the user to arrive at an average player profile. The system can repeat this process for each club specified by the user.

The system can store the data in a player profile at step 320, for example in a database (e.g., data store 115). In some implementations, the system can access atmospheric or environmental conditions, such as those gathered from another computing device via the network, or from the launch monitor, and store the average player profile in association with the atmospheric or environmental conditions. As such, the baseline player swing and flight data may be stored with information about the atmospheric or environmental conditions under which the swing and flight data was gathered, thereby creating a baseline profile for the player.

Once the player profile has been generated, to perform prediction or estimation of flight characteristics, the system can identify present atmospheric or environmental conditions at step 325 at a location of the device (e.g., mobile device) or at a specified location (e.g. a particular course, tee, etc.). After establishing the profile, the system, for example as part of an application, may provide the functionalities detailed herein above or the functionalities detailed herein below, for example allowing the player to specify golf club parameters, manually specify atmospheric or environmental conditions, or automatically gather and display atmospheric or environmental conditions from one or more sensors on the mobile device (e.g., thermometer, barometer, etc.), or from one or more other computing devices via a network (e.g., the network 110). The other computing devices can maintain, for example, the atmospheric or environmental data, and provide it to the mobile device or system in response to one or more requests. The atmospheric or environmental conditions can include temperature, wind speed, elevation, barometric pressure, and humidity, among others. In some implementations, the atmospheric or environmental conditions can include one or more drag coefficients.

At step 330, in some implementations, the system may select an initial set of coefficients from a coefficient array. In some embodiments, the system may utilize input values from the player profile (e.g. launch angle, speed, spin ratio, etc.). In other embodiments, the system may capture input values via a launch monitor for real-time estimation and analysis. In some embodiments, the coefficients may further be selected based on the atmospheric or environmental conditions and/or a difference between present atmospheric or environmental conditions and conditions associated with the player profile. For example, in some implementations, the system may dynamically adjust one or more parameters based on a difference between atmospheric or environmental conditions associated with the player profile and present conditions, such as adjusting an initial drag coefficient based on a difference in temperature between present conditions and those associated with the player profile. In some implementations, the system may determine a mean sea level pressure (e.g. via an API request to a weather service or server, via direct measurement, etc.) and may calculate an absolute pressure given the present altitude and air temperature. The absolute pressure may then be used in calculating drag and flight characteristics. Similar adjustments may be made to characteristics associated with the player profile and/or present location.

At step 335, the system may calculate a position and velocity for the launched object at a future time increment (e.g. 5 milliseconds, 10 milliseconds, or any other such interval or increment) based on the selected coefficients and prior position and velocity. For example, for an initial calculation, the prior position may be a golf tee, launch platform, or other such position (e.g. $\{x, y, z\}=\{0, 0, 0\}$), and the velocity may be an average launch velocity (and angle in some implementations) from a player profile. The calculations may include any of the ballistics calculations discussed herein or others, and may incorporate atmospheric pressure and/or temperature, altitude, spin or angular velocity, or any other such parameters.

At step 340, the system may determine if the calculated position is at ground or below an altitude threshold. In some implementations, this may be whether a y (vertical) position is greater than 0, while in other implementations, the calculation may take into account horizontal displacement. For example, in some implementations, a course map or topology may be consulted and a ground altitude at a calculated x and z (longitudinal and lateral) position identified as a threshold. Thus, for example, the system may be able to account for a course that has a positive or negative (or varying) slope. If the position is not at or below the ground altitude (either y=0 or y determined based on x, z displacement), then steps 330-340 may be repeated iteratively.

As discussed above, when repeating step 330, new coefficients may be determined based on the prior calculated velocity (i.e. at step 335) as well as adjustments based on the prior coefficients to ball spin or other parameters. For example, the initial coefficients may include a parameter indicating that the angular velocity or spin of the ball may decay by 0.1% during the time increment, and the system may calculate a new angular velocity or spin for referencing the coefficient array at the subsequent iteration. Accordingly, each iteration may adjust the parameters (e.g. velocity, spin ratio, etc.) used for referencing the array, potentially resulting in new coefficients to be selected.

In some implementations, an adjustment may not change an input parameter such that different coefficients are selected. For example, if a spin to velocity ratio changes from 6 to 6.3 according to a decay parameter and a velocity changes from 188 MPH to 186 MPH during an increment, but the coefficient array uses the same index for a spin ratio range from 6 to 6.5 and velocity range from 190 MPH to 185 MPH, then the same coefficients may be selected at the subsequent iteration of step 330. An example of extraordinary spin decay would be due to the golf ball being wet due to dew from the grass or rain. Other coefficients may similarly change drastically during the course of flight. The actual calculated values of the parameters are retained however, such that on a subsequent iteration (e.g. the next or a later iteration), further decay may cause the system to select new coefficients. Accordingly, the coefficients selected at step 330 may be (and frequently will be) different but are not required to be different during any particular successive iteration.

Once a position at ground level is identified at step 340, then at step 345, the resulting ballistics information may be presented via a user interface. The system can generate a user interface to display or gather any of the information described herein. For example, the system may populate one or more data structures, profile information, average ballistics or flight information, or any other information used by the system or the components thereof. In addition, the system can display or provide the results of any of the computations, for example in one or more windows, applications, or graphical representations on the display of the computing device. The system can display, for example as text or an image, the current atmospheric or environmental data, projected atmospheric or environmental data, future atmospheric or environmental data, or the expected distance a golf ball will travel for a particular club and player profile. If, for example, data gathered from a laser range finder (e.g., the laser range finder 150) indicates that the target hole is a certain distance away, the mobile device can display or suggest a club that will provide an average expected distance for a golf ball given the current or future atmospheric or environmental conditions.

Although primarily discussed in terms of golf balls, the systems and methods discussed herein may be applied to dynamic estimations of flight characteristics of any object, such as Frisbees or flying discs, baseballs, softballs, basketballs, tennis balls, cricket balls, or other game balls, as well as other projectiles such as arrows, bolts, bullets, shot, or other such unpowered launched, hit, or thrown objects. The various drag and lift coefficients may be varied for different objects, but many implementations of the systems and methods discussed herein utilizing an iterative application of coefficients from a coefficient array may apply to these other contexts. Accordingly, the systems and methods herein should not be considered to be limited to golf ball flight estimations.

In a first aspect, the present disclosure is directed to a method for dynamic prediction of golf ball ballistics. The method includes receiving, by one or more processors of a device, a user profile comprising one or more golf ball launch characteristics. The method also includes retrieving, by the one or more processors, atmospheric or environmental metrics at a first location. The method also includes iteratively, for a plurality of time increments: selecting, by the one or more processors, a set of coefficients from an array of sets of coefficients based on the retrieved atmospheric or environmental metrics; and calculating, by the one or more processors, a position and velocity of a golf ball at a time instant. During a first iteration, calculating the position and velocity of the golf ball is further based on the one or more golf ball launch characteristics; and during each subsequent iteration, calculating the position and velocity of the golf ball is based on the previous calculated position and velocity of the golf ball, and selecting the set of coefficients from the array of sets of coefficients is further based on the previous selected set of coefficients. The method also includes displaying, by the one or more processors via a display of the device, the calculated position of the golf ball corresponding to a threshold height value.

In some implementations, the one or more golf ball launch characteristics comprise an average launch speed, an average vertical launch angle, an average horizontal launch deflection, a spin rate and spin axis, a ball spin-speed ratio, or a club type. In some implementations, the atmospheric or environmental metrics comprise a temperature, an air pressure, a humidity, a wind speed and direction, or an altitude. In some implementations, the one or more golf ball launch characteristics are associated with atmospheric or environmental metrics at a second location. In a further implementation, during the first iteration, selecting the set of coefficients from the array of sets of coefficients is further based on a difference between the atmospheric or environmental metrics at the first location and the atmospheric or environmental metrics at the second location.

In some implementations, the set of coefficients selected during an iteration are different from the set of coefficients selected during a different iteration. In some implementations, iteratively selecting the set of coefficients and calculating the position and velocity of the golf ball is repeated until a calculated height of the golf ball corresponds to the threshold height value. In some implementations, the threshold height value is a ground altitude of a golf course. In some implementations, the time increments of each iteration are separated by 0.05 seconds. In some implementations, the method includes calculating the position and velocity of the golf ball in three dimensions.

In another aspect, the present disclosure is directed to a device for dynamic prediction of golf ball ballistics. The device includes one or more processors, a storage device storing a user profile comprising one or more golf ball launch characteristics and an array of sets of coefficients, and a display. The one or more processors are configured to retrieve atmospheric or environmental metrics at a first location. The one or more processors are also configured to, iteratively, for a plurality of time increments: select a set of coefficients from the array of sets of coefficients based on the retrieved atmospheric or environmental metrics; and calculate a position and velocity of a golf ball at a time increment. During a first iteration, calculating the position and velocity of the golf ball is further based on the one or more golf ball launch characteristics, and during each subsequent iteration, calculating the position and velocity of the golf ball is based on the previous calculated position and velocity of the golf ball, and selecting the set of coefficients from the array of sets of coefficients is further based on the previous selected set of coefficients. The one or more processors are also configured to display, via the display, the calculated position of the golf ball corresponding to a threshold height value.

In some implementations, the one or more golf ball launch characteristics comprise an average launch speed, an average vertical launch angle, an average horizontal launch deflection, a spin rate and spin axis, a ball spin-speed ratio, or a club type. In some implementations, the atmospheric or environmental metrics comprise a temperature, an air pressure, a humidity, a wind speed and direction, or an altitude. In some implementations, the one or more golf ball launch characteristics are associated with atmospheric or environmental metrics at a second location. In a further implementation, during the first iteration, selecting the set of coefficients from the array of sets of coefficients is further based on a difference between the atmospheric or environmental metrics at the first location and the atmospheric or environmental metrics at the second location.

In some implementations, the set of coefficients selected during an iteration are different from the set of coefficients selected during a different iteration. In some implementations, iteratively selecting the set of coefficients and calculating the position and velocity of the golf ball is repeated until a calculated height of the golf ball corresponds to the threshold height value. In some implementations, the threshold height value is a ground altitude of a golf course. In some implementations, the time increments of each iteration are separated by 0.05 seconds. In some implementations, the one or more processors are further configured to calculate the position and velocity of the golf ball in three dimensions during each iteration.

B. Computing Environment

Having discussed specific embodiments of the present solution, it may be helpful to describe aspects of the operating environment as well as associated system components (e.g., hardware elements) in connection with the methods and systems described herein.

The systems discussed herein may be deployed as and/or executed on any type and form of computing device, such as a computer, network device or appliance capable of communicating on any type and form of network and performing the operations described herein. FIGS. 4A and 4B depict block diagrams of a computing device 400 useful for practicing an embodiment of the wireless communication devices 402 or the access point 406. As shown in FIGS. 4A and 4B, each computing device 400 includes a central processing unit 421, and a main memory unit 422. As shown in FIG. 4A, a computing device 400 may include a storage device 428, an installation device 416, a network interface 418, an I/O controller 423, display devices 424*a*-424*n*, a keyboard 426 and a pointing device 427, such as a mouse. The storage device 428 may include, without limitation, an operating system and/or software. As shown in FIG. 4B, each computing device 400 may also include additional optional elements, such as a memory port 403, a bridge 470, one or more input/output devices 430*a*-430*n* (generally referred to using reference numeral 430), and a cache memory 440 in communication with the central processing unit 421.

The central processing unit 421 is any logic circuitry that responds to and processes instructions fetched from the main memory unit 422. In many embodiments, the central processing unit 421 is provided by a microprocessor unit, such as: those manufactured by Intel Corporation of Mountain View, California; those manufactured by International Business Machines of White Plains, New York; or those manufactured by Advanced Micro Devices of Sunnyvale, California. The computing device 400 may be based on any of these processors, or any other processor capable of operating as described herein.

Main memory unit 422 may be one or more memory chips capable of storing data and allowing any storage location to be directly accessed by the microprocessor 421, such as any type or variant of Static random access memory (SRAM), Dynamic random access memory (DRAM), Ferroelectric RAM (FRAM). NAND Flash, NOR Flash and Solid State Drives (SSD). The main memory 422 may be based on any of the above described memory chips, or any other available memory chips capable of operating as described herein. In the embodiment shown in FIG. 4A, the processor 421 communicates with main memory 422 via a system bus 450 (described in more detail below). FIG. 4B depicts an embodiment of a computing device 400 in which the processor communicates directly with main memory 422 via a memory port 403. For example, in FIG. 4B the main memory 422 may be DRDRAM.

FIG. 4B depicts an embodiment in which the main processor 421 communicates directly with cache memory 440 via a secondary bus, sometimes referred to as a backside bus. In other embodiments, the main processor 421 communicates with cache memory 440 using the system bus 450. Cache memory 440 typically has a faster response time than main memory 422 and is provided by, for example, SRAM, BSRAM, or EDRAM. In the embodiment shown in FIG. 4B, the processor 421 communicates with various I/O devices 430 via a local system bus 450. Various buses may be used to connect the central processing unit 421 to any of the F/O devices 430, for example, a VESA VL bus, an ISA bus, an EISA bus, a MicroChannel Architecture (MCA) bus, a PCI bus, a PCI-X bus, a PCI-Express bus, or a NuBus. For embodiments in which the I/O device is a video display 424, the processor 421 may use an Advanced Graphics Port (AGP) to communicate with the display 424. FIG. 43 depicts an embodiment of a computer 400 in which the main processor 421 may communicate directly with I/O device 430*b*, for example via HYPERTRANSPORT, RAPIDIO, or INFINIBAND communications technology. FIG. 4B also depicts an embodiment in which local busses and direct communication are mixed: the processor 421 communicates with L/O device 430*a* using a local interconnect bus while communicating with I/O device 430*b* directly.

A wide variety of I/O devices 430*a*-430*n* may be present in the computing device 400. Input devices include keyboards, mice, trackpads, trackballs, microphones, dials, touch pads, touch screen, and drawing tablets. Output devices include video displays, speakers, inkjet printers, laser printers, projectors and dye-sublimation printers. The I/O devices may be controlled by an I/O controller 423 as shown in FIG. 4A. The I/O controller may control one or more I/O devices such as a keyboard 426 and a pointing device 427, e.g., a mouse or optical pen. Furthermore, an I/O device may also provide storage and/or an installation medium 416 for the computing device 400. In still other embodiments, the computing device 400 may provide USB connections (not shown) to receive handheld USB storage devices such as the USB Flash Drive line of devices manufactured by Twintech Industry, Inc. of Los Alamitos, California.

Referring again to FIG. 4A, the computing device 400 may support any suitable installation device 416, such as a disk drive, a CD-ROM drive, a CD-R/RW drive, a DVD-ROM drive, a flash memory drive, tape drives of various formats, USB device, hard-drive, a network interface, or any other device suitable for installing software and programs. The computing device 400 may further include a storage device, such as one or more hard disk drives or redundant arrays of independent disks, for storing an operating system and other related software, and for storing application software programs such as any program or software 420 for implementing (e.g., configured and/or designed for) the systems and methods described herein. Optionally, any of the installation devices 416 could also be used as the storage device. Additionally, the operating system and the software can be run from a bootable medium.

Furthermore, the computing device 400 may include a network interface 418 to interface to the network 404 through a variety of connections including, but not limited to, standard telephone lines, LAN or WAN links (e.g., 802.11, T1, T3, 56 kb, X.25, SNA, DECNET), broadband connections (e.g., ISDN, Frame Relay, ATM, Gigabit Ethernet, Ethernet-over-SONET), wireless connections, or some combination of any or all of the above. Connections can be established using a variety of communication protocols (e.g., TCP/IP, IPX, SPX, NeIBIOS, Ethernet, ARCNET, SONET, SDH, Fiber Distributed Data Interface (FDDI), RS232, IEEE 802.11, IEEE 802.11a, IEEE 802.11b, IEEE 802.11g, IEEE 802.11n, IEEE 802.11ac, IEEE 802.11ad, CDMA, GSM, WiMax and direct asynchronous connections). In one embodiment, the computing device 400 communicates with other computing devices 400' via any type and/or form of gateway or tunneling protocol such as Secure Socket Layer (SSL) or Transport Layer Security (TLS). The network interface 418 may include a built-in network adapter, network interface card, PCMCIA network card, card bus network adapter, wireless network adapter, USB network adapter, modem or any other device suitable for interfacing the computing device 400 to any type of network capable of communication and performing the operations described herein.

In some embodiments, the computing device 400 may include or be connected to one or more display devices 424*a*-424*n*. As such, any of the I/O devices 430*a*-430*n* and/or the I/O controller 423 may include any type and/or form of suitable hardware, software, or combination of hardware and software to support, enable or provide for the connection and use of the display device(s) 424*a*-424*n* by the computing device 400. For example, the computing device 400 may include any type and/or form of video adapter, video card, driver, and/or library to interface, communicate, connect or otherwise use the display device(s) 424*a*-424*n*. In one embodiment, a video adapter may include multiple connectors to interface to the display device(s) 424*a*-424*n*. In other embodiments, the computing device 400 may include multiple video adapters, with each video adapter connected to the display device(s) 424*a*-424*n*. In some embodiments, any portion of the operating system of the computing device 400 may be configured for using multiple displays 424*a*-424*n*. One ordinarily skilled in the art will recognize and appreciate the various ways and embodiments that a computing device 400 may be configured to have one or more display devices 424*a*-424*n*.

In further embodiments, an I/O device 430 may be a bridge between the system bus 450 and an external communication bus, such as a USB bus, an Apple Desktop Bus, an RS-232 serial connection, a SCSI bus, a FireWire bus, a FireWire 800 bus, an Ethernet bus, an AppleTalk bus, a Gigabit Ethernet bus, an Asynchronous Transfer Mode bus, a FibreChannel bus, a Serial Attached small computer system interface bus, a USB connection, or a HDMI bus.

A computing device 400 of the sort depicted in FIGS. 4A and 4B may operate under the control of an operating system, which control scheduling of tasks and access to system resources. The computing device 400 can be running any operating system such as any of the versions of the MICROSOFT WINDOWS operating systems, the different releases of the Unix and Linux operating systems, any version of the MAC OS for Macintosh computers, any embedded operating system, any real-time operating system, any open source operating system, any proprietary operating system, any operating systems for mobile computing devices, or any other operating system capable of running on the computing device and performing the operations described herein. Typical operating systems include, but are not limited to: Android, produced by Google Inc.; WINDOWS 7 and 8, produced by Microsoft Corporation of Redmond, Washington; MAC OS, produced by Apple Computer of Cupertino, California; WebOS, produced by Research In Motion (RIM); OS/2, produced by International Business Machines of Armonk, New York; and Linux, a freely-available operating system distributed by Caldera Corp. of Salt Lake City, Utah, or any type and/or form of a Unix operating system, among others.

The computer system 400 can be any workstation, telephone, desktop computer, laptop or notebook computer, server, handheld computer, mobile telephone or other portable telecommunications device, media playing device, a gaming system, mobile computing device, or any other type and/or form of computing, telecommunications or media device that is capable of communication. The computer system 400 has sufficient processor power and memory capacity to perform the operations described herein.

In some embodiments, the computing device 400 may have different processors, operating systems, and input devices consistent with the device. For example, in one embodiment, the computing device 400 is a smart phone, mobile device, tablet or personal digital assistant. In still other embodiments, the computing device 400 is an Android-based mobile device, an iPhone smart phone manufactured by Apple Computer of Cupertino, California, or a Blackberry or WebOS-based handheld device or smart phone, such as the devices manufactured by Research In Motion Limited. Moreover, the computing device 400 can be any workstation, desktop computer, laptop or notebook computer, server, handheld computer, mobile telephone, any other computer, or other form of computing or telecommunications device that is capable of communication and that has sufficient processor power and memory capacity to perform the operations described herein.

Although the disclosure may reference one or more "users", such "users" may refer to user-associated devices or stations (STAs), for example, consistent with the terms "user" and "multi-user" typically used in the context of a multi-user multiple-input and multiple-output (MU-MIMO) environment.

Although examples of communications systems described above may include devices and APs operating according to an 802.11 standard, it should be understood that embodiments of the systems and methods described can operate according to other standards and use wireless communications devices other than devices configured as devices and APs. For example, multiple-unit communication interfaces associated with cellular networks, satellite communications, vehicle communication networks, and other non-802.11 wireless networks can utilize the systems and methods described herein to achieve improved overall capacity and/or link quality without departing from the scope of the systems and methods described herein.

It should be noted that certain passages of this disclosure may reference terms such as "first" and "second" in connection with devices, mode of operation, transmit chains, antennas, etc., for purposes of identifying or differentiating one from another or from others. These terms are not intended to merely relate entities (e.g., a first device and a second device) temporally or according to a sequence, although in some cases, these entities may include such a relationship. Nor do these terms limit the number of possible entities (e.g., devices) that may operate within a system or environment.

It should be understood that the systems described above may provide multiple ones of any or each of those components and these components may be provided on either a standalone machine or, in some embodiments, on multiple machines in a distributed system. In addition, the systems and methods described above may be provided as one or more computer-readable programs or executable instructions embodied on or in one or more articles of manufacture. The article of manufacture may be a floppy disk, a hard disk, a CD-ROM, a flash memory card, a PROM, a RAM, a ROM, or a magnetic tape. In general, the computer-readable programs may be implemented in any programming language, such as LISP, PERL, C, C++, C#, PROLOG, or in any byte code language such as JAVA. The software programs or executable instructions may be stored on or in one or more articles of manufacture as object code.

While the foregoing written description of the methods and systems enables one of ordinary skill to make and use what is considered presently to be the best mode thereof, those of ordinary skill will understand and appreciate the existence of variations, combinations, and equivalents of the specific embodiment, method, and examples herein. The present methods and systems should therefore not be limited by the above described embodiments, methods, and examples, but by all embodiments and methods within the scope and spirit of the disclosure.

I claim:

1. A method for dynamic prediction of golf ball ballistics, comprising:

receiving, by one or more processors of a device, a user profile comprising one or more golf ball launch characteristics;

retrieving, by the one or more processors, atmospheric or environmental metrics at a first location;

iteratively, for a plurality of time increments:

selecting, by the one or more processors, a set of coefficients from an array of sets of coefficients based on the retrieved atmospheric or environmental metrics, and calculating, by the one or more processors, a position and velocity of a golf ball at a time increment, wherein during a first iteration, calculating the position and velocity of the golf ball is further based on the one or more golf ball launch characteristics, and wherein during each subsequent iteration, calculating the position and velocity of the golf ball is based on the previous calculated position and velocity of the golf ball, and selecting the set of coefficients from the array of sets of coefficients is further based on the previous selected set of coefficients; and displaying, by the one or more processors via a display of the device, the calculated position of the golf ball corresponding to a threshold height value.

2. The method of claim 1, wherein the one or more golf ball launch characteristics comprise an average launch speed, an average vertical launch angle, an average horizontal launch deflection, a spin rate and spin axis, a ball spin-speed ratio, or a club type.

3. The method of claim 1, wherein the atmospheric or environmental metrics comprise a temperature, an air pressure, a humidity, a wind speed and direction, or an altitude.

4. The method of claim 1, wherein the one or more golf ball launch characteristics are associated with atmospheric or environmental metrics at a second location.

5. The method of claim 4, wherein during the first iteration, selecting the set of coefficients from the array of sets of coefficients is further based on a difference between the atmospheric or environmental metrics at the first location and the atmospheric or environmental metrics at the second location.

6. The method of claim 1, wherein the set of coefficients selected during an iteration are different from the set of coefficients selected during a different iteration.

7. The method of claim 1, wherein iteratively selecting the set of coefficients and calculating the position and velocity of the golf ball is repeated until a calculated height of the golf ball corresponds to the threshold height value.

8. The method of claim 1, wherein the threshold height value is a ground altitude of a golf course.

9. The method of claim 1, wherein the time increments of each iteration are separated by 0.05 seconds.

10. The method of claim 1, wherein calculating the position and velocity of the golf ball further comprises calculating the position and velocity of the golf ball in three dimensions.

11. A device for dynamic prediction of golf ball ballistics, comprising:

one or more processors, a storage device storing a user profile comprising one or more golf ball launch characteristics and an array of sets of coefficients, and a display; and wherein the one or more processors are configured to:

retrieve atmospheric or environmental metrics at a first location, iteratively, for each of a plurality of time increments:

select a set of coefficients from the array of sets of coefficients based on the retrieved atmospheric or environmental metrics; and calculate a position and velocity of a golf ball at a time increment;

wherein during a first iteration, calculating the position and velocity of the golf ball is further based on the one or more golf ball launch characteristics, and wherein during each subsequent iteration, calculating the position and velocity of the golf ball is based on the previous calculated position and velocity of the golf ball, and selecting the set of coefficients from the array of sets of coefficients is further based on the previous selected set of coefficients, and display, via the display, the calculated position of the golf ball corresponding to a threshold height value.

12. The system of claim 11, wherein the one or more golf ball launch characteristics comprise an average launch speed, an average vertical launch angle, an average horizontal launch deflection, a spin rate and spin axis, a ball spin-speed ratio, or a club type.

13. The system of claim 11, wherein the atmospheric or environmental metrics comprise a temperature, an air pressure, a humidity, a wind speed and direction, or an altitude.

14. The system of claim 11, wherein the one or more golf ball launch characteristics are associated with atmospheric or environmental metrics at a second location.

15. The system of claim 14, wherein during the first iteration, selecting the set of coefficients from the array of sets of coefficients is further based on a difference between the atmospheric or environmental metrics at the first location and the atmospheric or environmental metrics at the second location.

16. The system of claim 11, wherein the set of coefficients selected during an iteration are different from the set of coefficients selected during a different iteration.

17. The system of claim 11, wherein iteratively selecting the set of coefficients and calculating the position and velocity of the golf ball is repeated until a calculated height of the golf ball corresponds to the threshold height value.

18. The system of claim 11, wherein the threshold height value is a ground altitude of a golf course.

19. The system of claim 11, wherein the time increments of each iteration are separated by 0.05 seconds.

20. The system of claim 11, wherein the one or more processors are further configured to calculate the position and velocity of the golf ball in three dimensions during each iteration.

* * * * *